US006774330B2

(12) United States Patent
Blossfeld et al.

(10) Patent No.: US 6,774,330 B2
(45) Date of Patent: Aug. 10, 2004

(54) MULTI-STAGE PUSH BUTTON SWITCH APPARATUS

(75) Inventors: Mike Blossfeld, South Lyon, MI (US); Timothy E. Hughes, Livonia, MI (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/818,127

(22) Filed: Mar. 27, 2001

(65) Prior Publication Data

US 2002/0139653 A1 Oct. 3, 2002

(51) Int. Cl.[7] ..... H01H 1/02
(52) U.S. Cl. ..... 200/512; 200/406
(58) Field of Search ..... 200/510–517, 200/329, 341, 406, 5 A

(56) References Cited

U.S. PATENT DOCUMENTS

| | | | | |
|---|---|---|---|---|
| 4,418,257 A | | 11/1983 | Muller et al. | |
| 4,430,531 A | | 2/1984 | Wright | |
| 4,604,509 A | | 8/1986 | Claney et al. | |
| 4,659,881 A | | 4/1987 | Dowe | |
| 4,766,271 A | | 8/1988 | Mitsuhashi et al. | |
| 4,952,761 A | * | 8/1990 | Viebrantz | 200/513 |
| 5,228,561 A | | 7/1993 | Schroeder et al. | |
| 5,389,757 A | * | 2/1995 | Souliere | 200/345 |
| 5,564,560 A | | 10/1996 | Minelli et al. | |
| 5,834,714 A | | 11/1998 | Berger et al. | |
| 5,912,612 A | * | 6/1999 | DeVolpi | 338/95 |
| 5,924,555 A | * | 7/1999 | Sadamori et al. | 200/512 |
| 6,084,190 A | * | 7/2000 | Kenmochi | 200/341 |
| 6,166,662 A | * | 12/2000 | Chuang | 341/22 |
| 6,303,887 B1 | * | 10/2001 | Ando | 200/512 |

FOREIGN PATENT DOCUMENTS

| | | |
|---|---|---|
| DE | 2100517 | * 5/1982 |
| GB | 2 100 517 | * 6/1981 |

* cited by examiner

*Primary Examiner*—Michael Friedhoffer
*Assistant Examiner*—Lisa Klaus
(74) *Attorney, Agent, or Firm*—Tarolli, Sundheim, Covell & Tummino L.L.P.

(57) ABSTRACT

The apparatus (10) includes a depressible member (20), a first membrane (30), and a second membrane (40). The depressible member (20) has an unactuated condition and an actuated condition. The first membrane (30) is connected with the depressible member (20). The first membrane (30) resists movement of the depressible member (20) from the unactuated condition to the actuated condition. The first membrane (30) further provides an increasing return force (91) urging the depressible member (20) to the unactuated condition as the operator moves the depressible member from the unactuated condition to the actuated condition. The second membrane (40) resists movement of the depressible member (20) to the actuated condition. The second membrane (40) further provides an increasing return force (92) to the depressible member (20) as the operator moves the depressible member from the unactuated condition to the actuated condition. The first membrane (30) initially acts alone and then acts simultaneously with the second membrane (40), and the membranes (30, 40) provide a tactile sensation to the operator due to a reduction in the combined forces applied to the depressible member (20) by the first and second membranes.

12 Claims, 2 Drawing Sheets

MULTI-STAGE PUSH BUTTON SWITCH APPARATUS

FIELD OF THE INVENTION

The present invention relates to an apparatus and, in particular to an electrical switch apparatus, capable of providing an operator with a tactile sensation.

BACKGROUND OF THE INVENTION

A conventional switch apparatus includes a push button, a snap dome connected to the push button, and an electrical contact on a mounting surface. When a minimal amount of force is applied to the push button by an operator, the snap dome resists movement of the push button.

As more force is applied to the push button by the operator, movement of the push button is effected, but the movement is still resisted by the snap dome. When the force applied to the push button increases to a predetermined amount, the snap dome snaps inwardly and no longer resists movement of the push button. When the snap dome snaps inwardly the operator feels a distinct tactile sensation. Also, a contact surface on the snap dome engages the electrical contact on the mounting surface and completes a circuit for performing a function.

The conventional apparatus may require a relatively small force by the operator (due to a relatively thin snap dome) to complete the circuit and may have a relatively long cycle life. Alternatively, the apparatus may require a relatively large force by the operator (due to a relatively thick snap dome) to complete the circuit, but may then have a relatively short cycle life because of greater stress incurred by the relatively thick snap dome with each cycle of operation.

SUMMARY OF THE INVENTION

The apparatus of the present invention includes a depressible member, a first membrane, and a second membrane. The depressible member has an unactuated condition and an actuated condition. The depressible member is moved by an operator. The first membrane is connected with the depressible member. The first membrane resists movement of the depressible member from the unactuated condition to the actuated condition. The first membrane further provides an increasing return force urging the depressible member to the unactuated condition as the operator moves the depressible member from the unactuated condition to the actuated condition. The second membrane also resists movement of the depressible member to the actuated condition. The second membrane further provides an increasing return force to the depressible member as the operator moves the depressible member to the actuated condition. The first membrane initially acts alone and then acts simultaneously with the second membrane. The first and second membranes provide a tactile sensation to the operator due to a reduction in the combined return forces applied to the depressible member by the first and second membranes during a portion of the movement of the depressible member by the operator.

The first and second membranes may be relatively thin and thus have a relatively long cycle life. Also, since the first and second membranes act simultaneously, the operator experiences a relatively high resistance to movement of the depressible member and a distinct tactile sensation when the reduction in the combined return forces occurs.

BRIEF DESCRIPTION OF THE DRAWINGS

The foregoing and other features of the present invention will become more apparent to one skilled in the art upon consideration of the following description of the invention and the accompanying drawings, in which.

DESCRIPTION OF THE PREFERRED EMBODIMENTS

Figure 1:
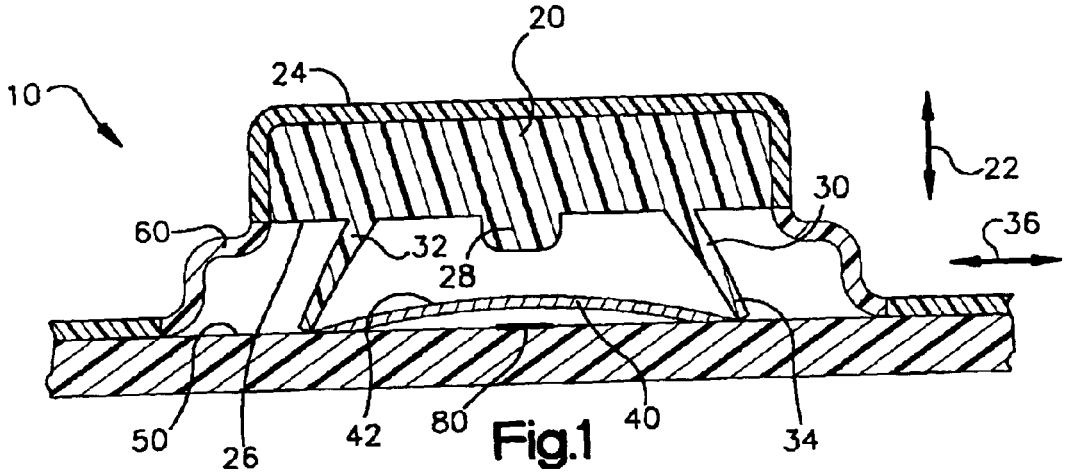
FIG. 1 is a schematic sectional view of an apparatus in accordance with the present invention.

According to the present invention, an apparatus 10 comprises a depressible member 20, a first membrane 30 that is shaped as a hollow, conical frustum, and a second circular, dome-shaped membrane 40. The first and second membranes 30, 40 provide forces resisting movement of the depressible member 20.

As viewed in FIG. 1, the upper, narrower portion of the first membrane 30 is attached to the depressible member 20 while the lower, wider portion extends away from the depressible member. Also in FIG. 1, the center portion of the second membrane 40 is disposed nearer to the depressible member 20 than the perimeter portion of the second membrane. The first and second membranes 30, 40 are configured to have a convex surface facing toward the depressible member and a concave surface facing away from the depressible member 20 in the condition shown in FIG. 1.

Figure 3:
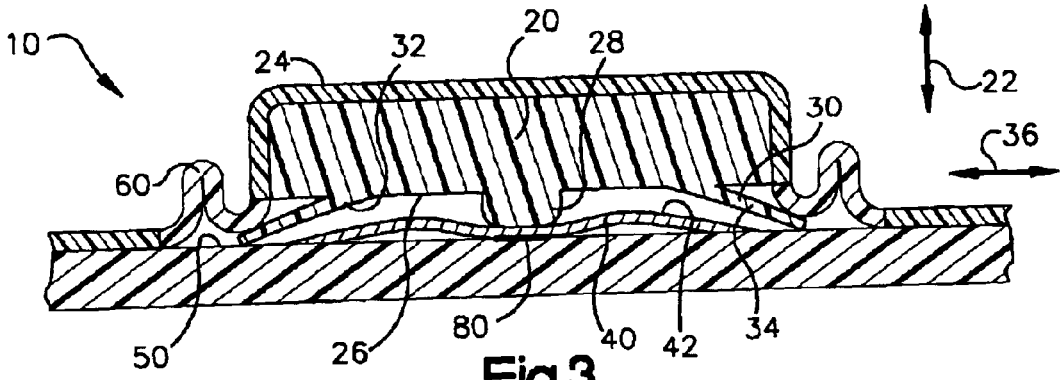
FIG. 3 is a schematic sectional view of the apparatus of FIG. 1 showing parts in still other positions.

The depressible member 20 is a button and may move from an unactuated condition (shown in FIG. 1) to an actuated condition (shown in FIG. 3). The depressible member 20 moves linearly and downwardly (as shown in the drawings) in a first direction (indicated by the arrow 22) from the unactuated condition to the actuated condition, and moves linearly and upwardly (as shown in the drawings) in a second direction (also indicated by the arrow 22) opposite the first direction from the actuated condition to the unactuated condition. The depressible member 20 is moved downwardly as viewed in the drawings by an operator. The depressible member 20 may be any suitable shape such as rectangular or cylindrical.

The depressible member has a lower surface 26 from which an actuator protrusion 28 extends downwardly, as viewed in the drawings, towards the second membrane 40. The actuator protrusion 28 engages the second membrane 40 as the depressible member 20 moves from the unactuated condition to the actuated condition thereby transferring loads to the second membrane 40. The actuator protrusion 28, the first membrane 30, and the depressible member 20 may be made of silicone rubber or another suitable elastomer and molded as one-piece.

Alternatively, the actuator protrusion 28 may be a separate piece attached in a suitable manner to the lower surface 26 of the depressible member 20. The actuator protrusion 28 may also be constructed of silicone rubber or another suitable elastomer.

The first membrane 30 surrounds the actuator protrusion 28. The first membrane 30 may be silicone rubber and molded as one-piece with the depressible member 20, as described above and shown in the drawings, or may be a separate piece attached in a suitable manner to the lower surface 26 of the depressible member.

The first membrane 30 elastically resists movement of the depressible member 20 from the unactuated condition to the actuated condition. The first membrane 30 further provides a spring-like, linearly increasing return force urging the depressible member 20 to the unactuated condition as the operator moves the depressible member from the unactuated condition toward the actuated condition.

The first membrane 30 has a first end 32 fixed to the depressible member 20 and a second end 34, opposite the first end. The second end 34 is circular and engages a planar mounting surface 50 in a circle. The second end 34 may slide along the planar mounting surface 50 as the depressible member moves from the unactuated condition to the actuated condition. The second end 34 of the first membrane 30 slides so as to expand the diameter of the circle of engagement between the second end 34 and the planar surface 50. The arrow 36 indicates this sliding which is transverse to the first direction (indicated by the arrow 22).

The second membrane 40 elastically resists movement of the depressible member 20 to the actuated condition. The second membrane 40 further provides an increasing return force urging the depressible member 20 to the unactuated condition as the operator moves the depressible member 20 toward the actuated condition. The second membrane 40 may be a dome constructed of a suitable metal such as stainless steel.

The first membrane 30 initially acts alone (FIG. 2) as the depressible member 20 moves from the unactuated condition (FIG. 1) in the first direction. Then, as the depressible member 20 moves further in the first direction, the first membrane 30 acts simultaneously (FIGS. 2 & 3) with the second membrane 40 to provide an increased resistance to movement of the depressible member 20 dependent upon the combined return forces applied to the depressible member by the first and second membranes.

The combined operational characteristics of both membranes 30, 40 enable the apparatus 10 to provide a smoothly increasing, high resistance to movement of the depressible member. These characteristics further provide a distinct tactile sensation to the operator, and yet a long cycle life since neither membrane 30, 40 needs to incur large stresses upon deflection.

The apparatus 10 further includes a third membrane 60. The third membrane 60 has a portion secured to an upper surface of the depressible member 20 as shown in the drawings. The third membrane has a surface portion 24 that is engaged by the operator to apply force to depress the depressible member 20. The third membrane 60 encloses the depressible member 20 and the first and second membranes 30, 40 from environmental conditions. The membrane 60 is secured to the mounting surface 50. The third membrane 60 may be a seal pad constructed of a suitable elastomer such as rubber. The third membrane 60 provide minimal resistance to depression of the depressible member 20, and thus a minimal force acting to return the depressible member 20, to the position of FIG. 1.

Figure 2:
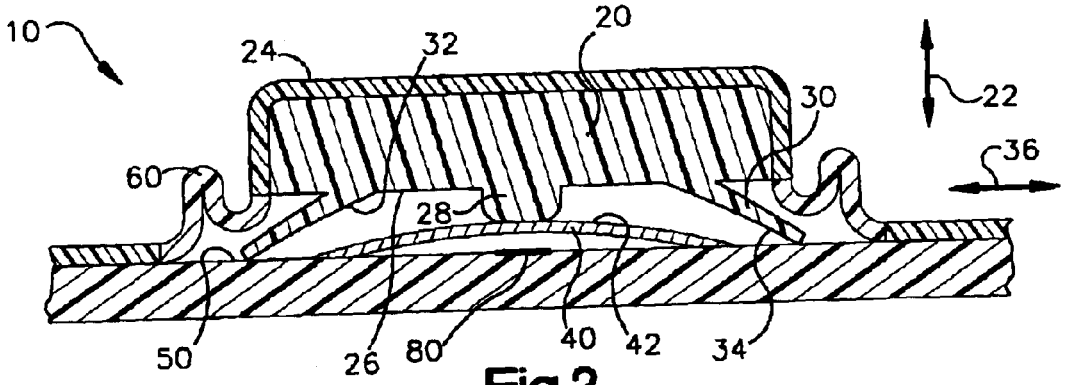
FIG. 2 is a schematic sectional view of the apparatus of FIG. 1 showing parts in different positions.
Figure 4:
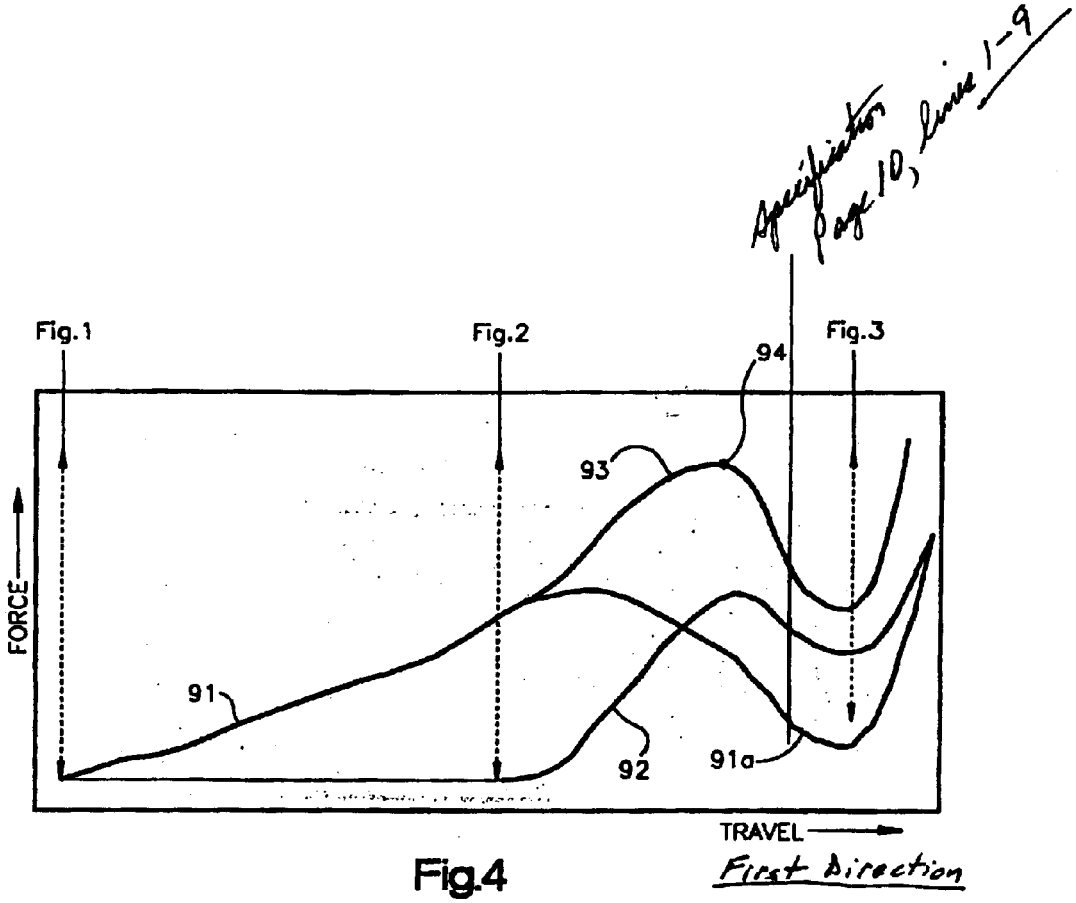
FIG. 4 is a graph showing the operational performance of the apparatus of FIG. 1.

The graph of FIG. 4 depicts, in curve 91, the return force applied to the depressible member 20 by the first membrane 30 as the depressible member travels downwardly as viewed in FIGS. 1–3. The location of "FIG. 1" in FIG. 4 indicates that when the parts of the apparatus 10 are in the positions shown in FIG. 1, the first membrane 30 applies no return force to the depressible member 20. As the depressible member 20 moves downward from the FIG. 1 position, the return force, shown by curve 91, applied to the depressible member 20 by the first membrane 30 initially increases substantially linearly.

The location of "FIG. 2" in FIG. 4 indicates that when the parts of the apparatus 10 are in the position shown in FIG. 2, the first membrane 30 applies a return force to the depressible member 20, but the second membrane 40 applies no return force to the depressible member. As the depressible member 20 moves downward from the FIG. 2 position, the second membrane 40 applies a return force to the depressible member 20, which return force is depicted by the curve 92. The first membrane 30 also applies an increasing return force to the depressible member 20 for a short amount of downward movement of the depressible member 20 from the FIG. 2 position. The first membrane 30 then begins to apply a decreasing amount of return force indicated by the portion 91*a* of the curve 91.

The second membrane 40, as shown by the curve 92, applies an increasing return force to the depressible member 20 during downward movement of the depressible member from the FIG. 2 position. The second membrane 40 then begins to apply a decreasing amount of return force to the depressible member 20.

The curve 93 in FIG. 4 depicts the sum of the return forces, or total return force, applied to the depressible member 20 by the first membrane 30 and the second membrane 40. During a portion of the downward movement of the depressible member 20, the second membrane 40 is applying an increasing return force to the depressible member while the first membrane 30 is applying a decreasing return force to the depressible member. However, the total force, i.e., the sum of the two forces, is increasing as shown by curve 93. Point 94 on the curve 93 is the point of maximum return force being applied to the depressible member 20 by the combination of the first and second membranes 30, 40. After the depressible member 20 reaches a point in travel corresponding to point 94 on curve 93, the first and second membranes 30, 40 begin to apply a decreasing total force to the depressible member 20.

The decreasing total force continues to be applied by the first membrane 30 and the second membrane 40 until the parts reach the positions shown in FIG. 3. The location of "FIG. 3" in FIG. 4 indicates that when the parts are in the positions shown in FIG. 3, the first membrane 30 and the second membrane 40 apply substantially less return force to the depressible member 20 than when the parts of the apparatus 10 are in the position corresponding to point 94. As shown in FIG. 4, a small amount of travel of the depressible member 20 downward as viewed in the drawings (about 16% of the total travel of the depressible member) results in a substantial reduction (about a 40% reduction) in the return force applied to the depressible member 20 by the first and second membranes 30, 40, when the parts of the apparatus 10 move from the position corresponding to point 94 on curve 93 to the FIG. 3 position. This substantial reduction in the return force provides a distinct tactile sensation to the operator.

The apparatus 10 is an electrical switch. An electrical contact 80 is located on the mounting surface 50. As the depressible member 20 is moved downward in the first direction 22 against the simultaneously resisting first and second membranes 30, 40, the resisting force will reach a maximum amount at a predetermined location (point 94) as described above. When the operator moves the depressible member 20 further downward in the first direction 22, past the predetermined location, the second membrane 40 engages the electrical contact 80. The second membrane 40, being metal, may thereby complete a circuit that will perform a desired function.

Due to the elastic nature of the first and second membranes 30, 40, reduction of the force applied by the operator to the depressible member 20 will first cause the first and second membranes to move upward in the first direction 22, as viewed in the drawings, and disengage the second membrane from the electrical contact 80 on the mounting surface 50. The second membrane 40 will return to its configuration as shown in FIG. 2. Then, the first membrane 30 will act alone to disengage the actuator protrusion 28 from the second membrane 40. The depressible member 20 will move back to the unactuated condition (FIG. 1) due to the elastic force of the first membrane 30.

Throughout each cycle of the first and second membranes 30, 40, neither membrane may be substantially stressed since each membrane may be a thin-walled membrane. The combined effect of both the first and second membranes 30, 40 thus allows the apparatus 10 to provide a switch assembly which provides a relatively high resistance to actuation by the operator, a distinct tactile sensation to the operator, and also has a relatively long cycle life.

From the above description of the invention, those skilled in the art will perceive improvements, changes and modifications. For example, the membrane 40 could be partially metal and the part that is metal may engage the switch contact 80 to complete a circuit. Such improvements, changes and modifications within the normal skill of the art are intended to be included within the scope of the appended claims.

Having described the invention, the following is claimed:

1. An apparatus comprising:

a depressible member having an unactuated condition, said depressible member being movable to an actuated condition from said unactuated condition;

a first membrane connected with said depressible member, said first membrane resisting movement of said depressible member from said unactuated condition to said actuated condition, said first membrane further providing an increasing return force urging said depressible member to said unactuated condition as an operator moves said depressible member from said unactuated condition to said actuated condition; and a second membrane resisting movement of said depressible member to said actuated condition, said second membrane further providing an increasing return force to said depressible member as the operator moves said depressible member to said actuated condition;

said depressible member initially moving relative to said second membrane in a first direction, said first membrane initially resisting movement of said depressible member without said second membrane resisting movement of said depressible member, and thereafter said first membrane resisting movement of said depressible member simultaneously with said second membrane, said first and second membranes providing a single tactile sensation to the operator due to a reduction in the combined return forces applied to said depressible member by said first and second membrane after said first and second membranes resist movement of said depressible member simultaneously, said first and second membranes comprising a single electrical switch as said second membrane contacts a contact member in said actuated condition.

2. The apparatus as defined in claim 1 wherein said first and second membranes are configured to have a concave surface facing away from said depressible member in said unactuated condition.

3. The apparatus as defined in claim 1 wherein said first membrane has a first end fixed to a lower surface of said depressible member and a second end, opposite said first end, sliding along a planar surface as said depressible member moves from said unactuated condition to said actuated condition.

4. The apparatus as defined in claim 3 wherein said second end of said first membrane slides in a direction transverse to the direction of movement of said depressible member.

5. The apparatus as defined in claim 1 further including an electrical switch contact adjacent said second membrane.

6. The apparatus as defined in claim 5 wherein said second membrane is at least partially metal and engages said electrical switch contact to complete a circuit.

7. The apparatus as defined in claim 1 wherein said depressible member is spaced apart from said second membrane when said depressible member is in said unactuated condition.

8. The apparatus as defined in claim 1 wherein said second membrane is spaced apart from said depressible member while said first membrane is initially resisting movement of said depressible member.

9. The apparatus as defined in claim 1 wherein said first membrane is constructed integrally with said depressible member.

10. An apparatus comprising:

a depressible member having an unactuated condition and an actuated condition;

a first membrane connected with said depressible member, said first membrane resisting movement of said depressible member from said unactuated condition to said actuated condition, said first membrane further providing an increasing return force urging said depressible member to said unactuated condition as an operator moves said depressible member from said unactuated condition to said actuated condition;

a second membrane resisting movement of said depressible member to said actuated condition, said second membrane further providing an increasing return force to said depressible member as the operator moves said depressible member to said actuated condition; and a third membrane enclosing said first and said second membranes;

said first membrane initially acting alone then acting simultaneously with said second membrane and providing a tactile sensation to the operator due to a reduction in the combined return forces applied to said depressible member by said first and second membrane.

11. An apparatus comprising:

a depressible member being movable in a first direction from an unactuated condition to an actuated condition;

a first membrane connected with said depressible member, said first membrane resisting movement of said depressible member from said unactuated condition to said actuated condition, said first membrane further providing an increasing return force urging said depressible member to said unactuated condition as an operator moves said depressible member from said unactuated condition to said actuated condition; and a second membrane resisting movement of said depressible member to said actuated condition, said second membrane further providing an increasing return force to said depressible member as the operator moves said depressible member to said actuated condition;

said first membrane and said second membrane providing a single tactile sensation to the operator due to a reduction in the combined return forces applied to said depressible member by said first and second membranes, said first membrane being movable to a first condition wherein said first membrane resists movement of said depressible member, said second membrane not resisting movement of said depressible member when said first membrane is moved to said first condition, said first membrane being movable to a second condition wherein said first membrane resists movement of said depressible member, said second membrane resisting movement of said depressible member when said first membrane is moved to said second condition, said first and second membranes comprising a single electrical switch as said second membrane contacts a contact member in said actuated condition.

12. The apparatus as defined in claim 11 wherein said first membrane and said second membrane are spaced apart in both said unactuated condition and said actuated condition.

* * * * *